US011472685B1

(12) United States Patent
Thompson et al.

(10) Patent No.: US 11,472,685 B1
(45) Date of Patent: Oct. 18, 2022

(54) AERIAL PLATFORM OCCUPANCY DETECTION

(71) Applicant: Altec Industries, Inc., Birmingham, AL (US)

(72) Inventors: Jesse Thompson, Shepherdsville, KY (US); Daniel Peterson, Kansas City, MO (US); Michael P. Whitaker, Hodgenville, KY (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 17/557,689

(22) Filed: Dec. 21, 2021

(51) Int. Cl.
*B66F 17/00* (2006.01)
*A42B 3/04* (2006.01)
*B66F 11/04* (2006.01)

(52) U.S. Cl.
CPC ..... *B66F 17/006* (2013.01); *A42B 3/0433* (2013.01); *B66F 11/044* (2013.01)

(58) Field of Classification Search
CPC ..... B66F 17/006; B66F 11/044; A42B 3/0433
See application file for complete search history.

(56) References Cited

U.S. PATENT DOCUMENTS

| | | | | |
|---|---|---|---|---|
| 5,877,693 | A * | 3/1999 | Eyler | G01S 11/16 340/685 |
| 9,269,255 | B2 * | 2/2016 | Beaulieu | B66C 15/045 |
| 10,908,228 | B1 * | 2/2021 | Gorghuber | H04B 3/46 |
| 11,013,288 | B2 * | 5/2021 | Albalawi | H04B 1/385 |
| 2010/0117906 | A1 * | 5/2010 | Miller | G01S 13/825 342/385 |
| 2018/0233055 | A1 * | 8/2018 | Damnjanovic | B64C 39/024 |
| 2019/0339351 | A1 | 11/2019 | Sundia et al. | |
| 2022/0110088 | A1 * | 4/2022 | Bao | H04B 17/318 |

* cited by examiner

*Primary Examiner* — Daniel P Cahn
*Assistant Examiner* — Shiref M Mekhaeil
(74) *Attorney, Agent, or Firm* — Erise IP, P.A.

(57) ABSTRACT

Systems and methods for platform occupancy detection on an aerial device are described. An aerial platform may be provided for the aerial device. A worker may perform operations in the aerial platform and connect to an interlock system thereof. The worker may have an associated transmitter configured to transmit a signal. A first receiver and a second receiver may be disposed on the aerial platform to receive the signal. Based on the time difference between receiving the signal at the first receiver and receiving the signal at the second receiver, the position of the transmitter may be triangulated. If the transmitter is determined to be within the aerial platform and the worker is not connected to the interlock system, preventive actions may be taken before operation of the aerial platform is permitted.

24 Claims, 4 Drawing Sheets

AERIAL PLATFORM OCCUPANCY DETECTION

BACKGROUND

1. Field

Embodiments of the invention relate to occupancy detection. More specifically, embodiments of the invention relate to occupancy detection on aerial platforms.

2. Related Art

Utility workers commonly utilize an aerial device to reach inaccessible locations. The aerial device generally includes a boom assembly with an aerial platform connected to a distal end of the boom. One or more utility workers stand in the aerial platform. Utility workers typically use an aerial device to access overhead power lines and electric power components for installation, repair, and/or maintenance. The utility workers may also lift repair parts and other objects utilizing a jib associated with the aerial platform.

Aerial platforms often are equipped with safety measures, such as lanyard interlocks, that are used to secure utility workers to the platform. These safety measures may include functionality for detecting when a utility worker is attached to a lanyard interlock such that operation of the aerial device is prohibited until a safety connection is detected. However, such systems are deficient in determining how many workers are present on the aerial platform and, as such, how many connected interlocks should be detected before aerial device operations are allowed to proceed. When multiple workers work in the same aerial platform system, the inability to detect the number of workers in the aerial platform system may lead to aerial device operation being permitted when not all workers are connected to the requisite safety features. Further, previous methods for detecting the location of a worker in a worksite, comprise using geolocation techniques; however, these methods fail to detect both proximity to a fixed point and capacity on an aerial device.

What is needed are systems and methods for detecting occupancy on an aerial platform to ensure all workers present are connected to the requisite safety features.

SUMMARY

Embodiments of the invention solve the above-mentioned problems by providing systems and methods for platform occupancy detection on an aerial platform. The aerial platform may be a multi-man platform for allowing workers to access remote locations. The aerial platform may be configured with safety features that connect the workers to the platform to prevent falls. To ensure that every worker on the aerial platform is connected to a safety feature, the occupancy of the aerial platform may be automatically detected. A first receiver and a second receiver may be disposed on a first end and a second end of the aerial platform, respectively. Each worker may have an associated transmitter configured to signal the first receiver and the second receiver. The transmitter may be disposed on a hard hat, for example. Using triangulation, it may be determined if the transmitter is within the aerial platform area, thereby indicating worker occupancy. If the number of occupants is higher than the number of connected safety features, an alarm may sound and/or particular platform operations may be prevented.

A first embodiment of the invention is directed to a system for platform occupancy detection on an aerial platform, the system comprising the aerial platform disposed at a distal end of an aerial device, the aerial platform comprising a first side and a second side; a transmitter for transmitting a signal configured to be associated with a worker; a first receiver disposed near the first side of the aerial platform and configured to receive the signal from the transmitter; a second receiver disposed near the second side of the aerial platform and configured to receive the signal from the transmitter; and one or more non-transitory computer-readable media storing computer-executable instructions that, when executed by a processor, perform a method for platform occupancy detection on the aerial platform. The method may comprise: receiving a first time from the first receiver, the first time indicative of a time at which the signal was received at the first receiver; receiving a second time from the second receiver, the second time indicative of a time at which the signal was received at the second receiver; and determining a position of the transmitter based on a time difference between the first time and the second time.

A second embodiment of the invention is directed to a method for platform occupancy detection on an aerial platform, the method comprising: receiving an actuation of a control for operation of an aerial platform, said aerial platform disposed at a distal end of an aerial device; responsive to receiving the actuation of the control, transmitting a signal from a transmitter associated with a worker; receiving the signal at a first receiver, the first receiver disposed at a first side of the aerial platform; receiving the signal at a second receiver, the second receiver disposed at a second side of the aerial platform; determining if the transmitter is within the aerial platform based on the signal received at the first receiver and the second receiver; and responsive to determining that the transmitter is not within the aerial platform, preventing operation of the aerial platform.

A third embodiment of the invention is directed to a system for occupancy detection on an aerial device comprising an aerial platform system comprising a first side and a second side; at least one transmitter configured to be associated with a worker on the aerial platform system; at least one interlock configured to secure the worker to the aerial platform system; a first receiver disposed at the first side of the aerial platform system and configured to receive a signal from the transmitter, a second receiver disposed at the second side of the aerial platform system and configured to receive the signal from the transmitter; and one or more non-transitory computer-readable media storing computer-executable instructions that, when executed by a processor, perform a method for platform occupancy detection. The method may comprise: receiving a first time indicative of a length of time for the signal to reach the first receiver; receiving a second time indicative of a length of time for the signal to reach the second receiver; determining a position of the transmitter based on the first time and the second time; determining if the at least one interlock is connected to the aerial platform system, and responsive to determining the position of the transmitter is within the aerial platform system and determining the at least one interlock is connected to the aerial platform system, permitting operation of the aerial device.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
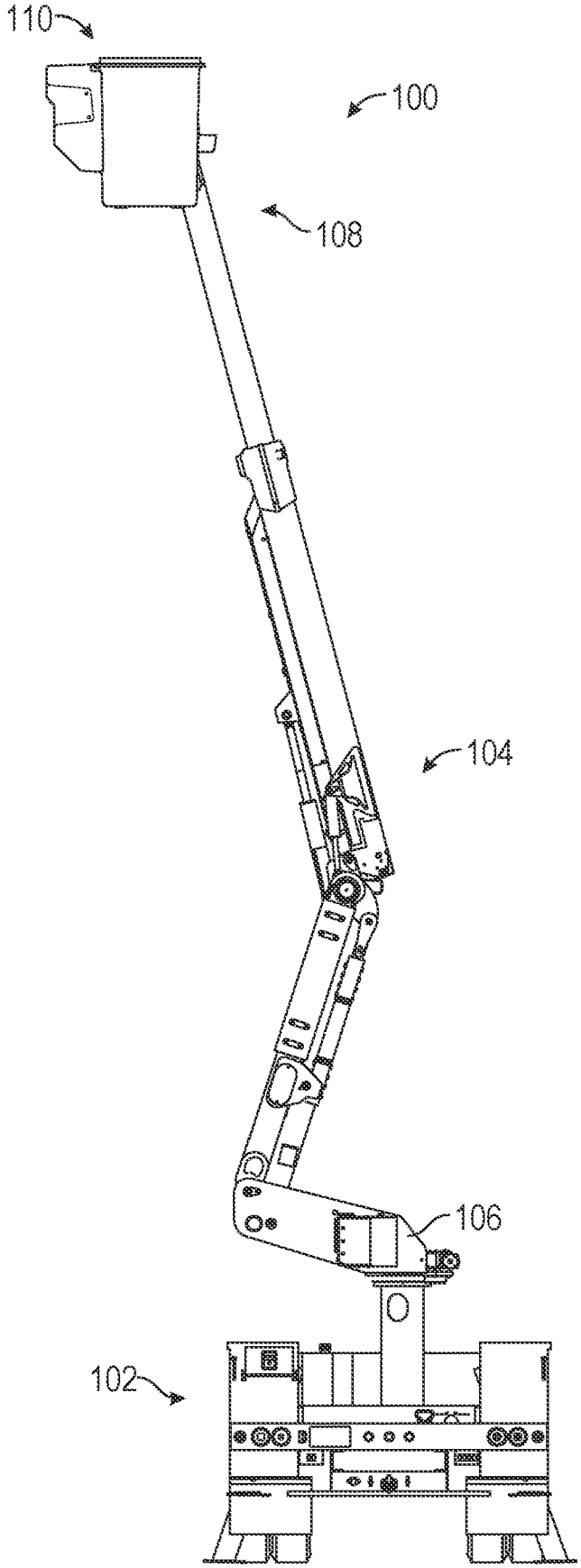
FIG. 1 depicts an aerial device for some embodiments.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Generally, embodiments of the current disclosure relate to detecting worker occupancy in a worksite. Workers often perform maintenance in remote places which are accessible via aerial platforms disposed on distal ends of booms, elevators, or other aerial devices. Because of the high height at which the maintenance is performed, aerial platforms are equipped with various safety features, such as lanyard interlocks or other fall protection systems, to prevent falls. To ensure that each worker present on the aerial platform is connected to the safety features, the occupancy of the aerial platform may be determined. Each worker may have an associated transmitter. Receivers may be disposed on or near the aerial platform. The receivers may receive signals from the transmitters and determine whether the transmitters are located within the aerial platform, such as via triangulation, trilateration, or multilateration. To determine the position of a transmitter, the time difference between the transmitted signal reaching each of the receivers may be used. If there is a discrepancy between the number of detected occupants and the number of connected safety features, preventative measures may be taken.

Turning first to FIG. 1, aerial device 100 for some embodiments of the invention is depicted. Aerial device 100 may be attached to utility vehicle 102, as shown. In some embodiments, aerial device 100 comprises boom assembly 104, upper boom section 108, and utility platform 110. Additionally, aerial device 100 comprises turntable 106 disposed on utility vehicle 102, as shown. As aerial device 100 is operated near electrically powered cables, in some embodiments, utility platform 110 and boom assembly 104 comprise insulating material for insulating aerial device 100. Furthermore, any electrical components disposed in the utility platform and on boom assembly 104 may be self-contained and electrically isolated from the electrical components of utility vehicle 102. As such, a dielectric gap is created between utility platform 110 and utility vehicle 102. In some embodiments, utility vehicle 102 may generally be referred to as a base, and may be any of a vehicle, a crane, a platform, a truck bed, a mechanical tree trimming apparatus, a hydraulic lift, or any other base capable of supporting boom assembly 104 and utility platform 110.

In some embodiments, an operator may be positioned on utility platform 110 for performing work on or near high-voltage power lines. The operator may access upper controls disposed on utility platform 110 as well as hydraulic tools for performing the work. In some embodiments, the operator on utility platform 110 may move to various positions using the upper controls. Furthermore, lower controls may be utilized at the base of aerial device 100 such as at utility vehicle 102 and at turntable 106. The operator may utilize a lanyard to prevent the operator from falling to the ground if the operator falls from utility platform 110 while performing the work. The lanyard detection unit described in embodiments herein may limit some or all operations of aerial device 100 and provide warnings to the operator and to any ground crew of the state of aerial device 100 and the state of the lanyard detection unit. Further, the platform occupancy detection system described in embodiments herein may limit operations of aerial device 100 and providing warnings to the operator and to any ground crew of the state of aerial device 100.

Figure 2A:
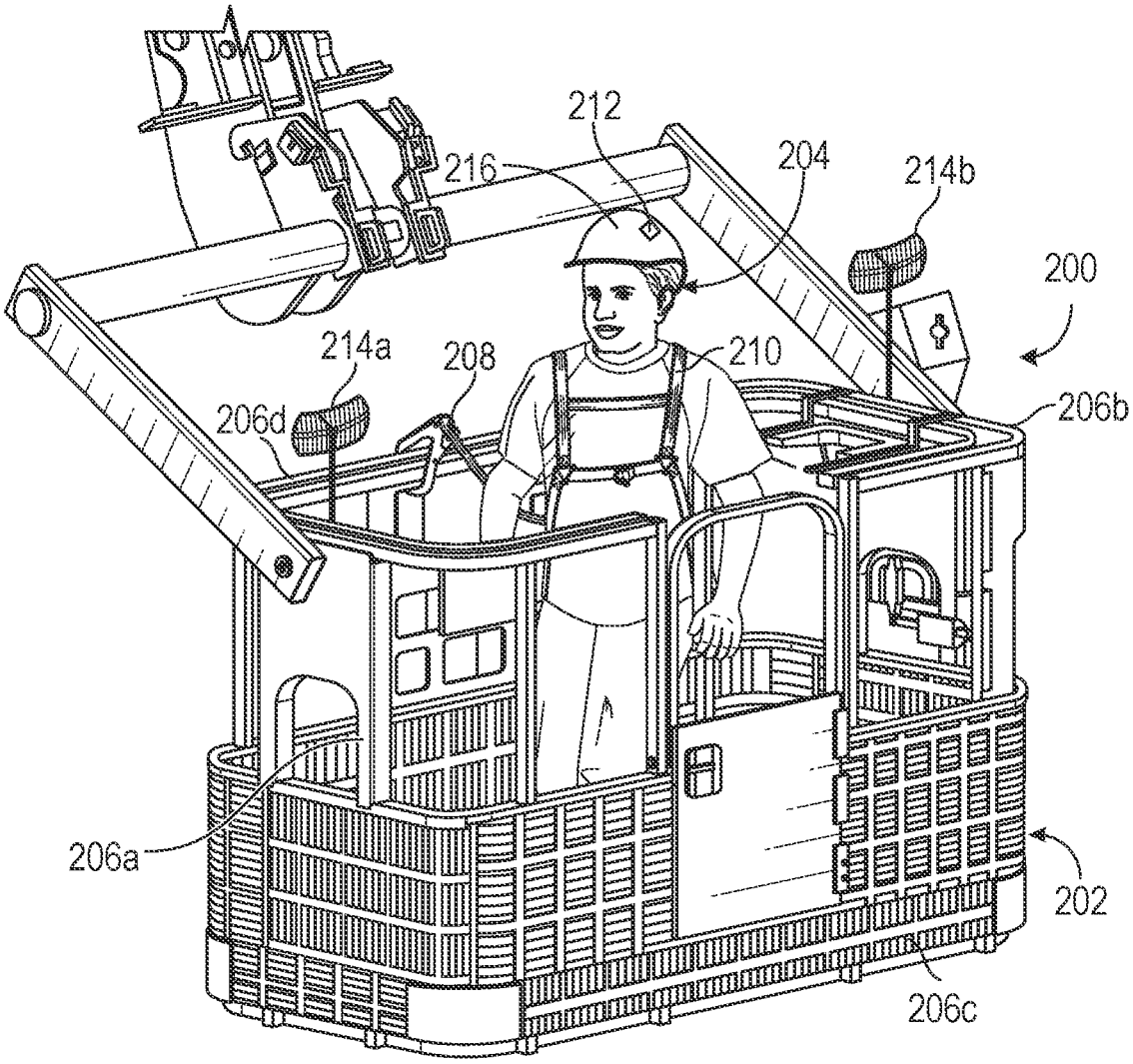
FIGS. 2A-2B depict embodiments of a platform occupancy detection system.
Figure 2B:
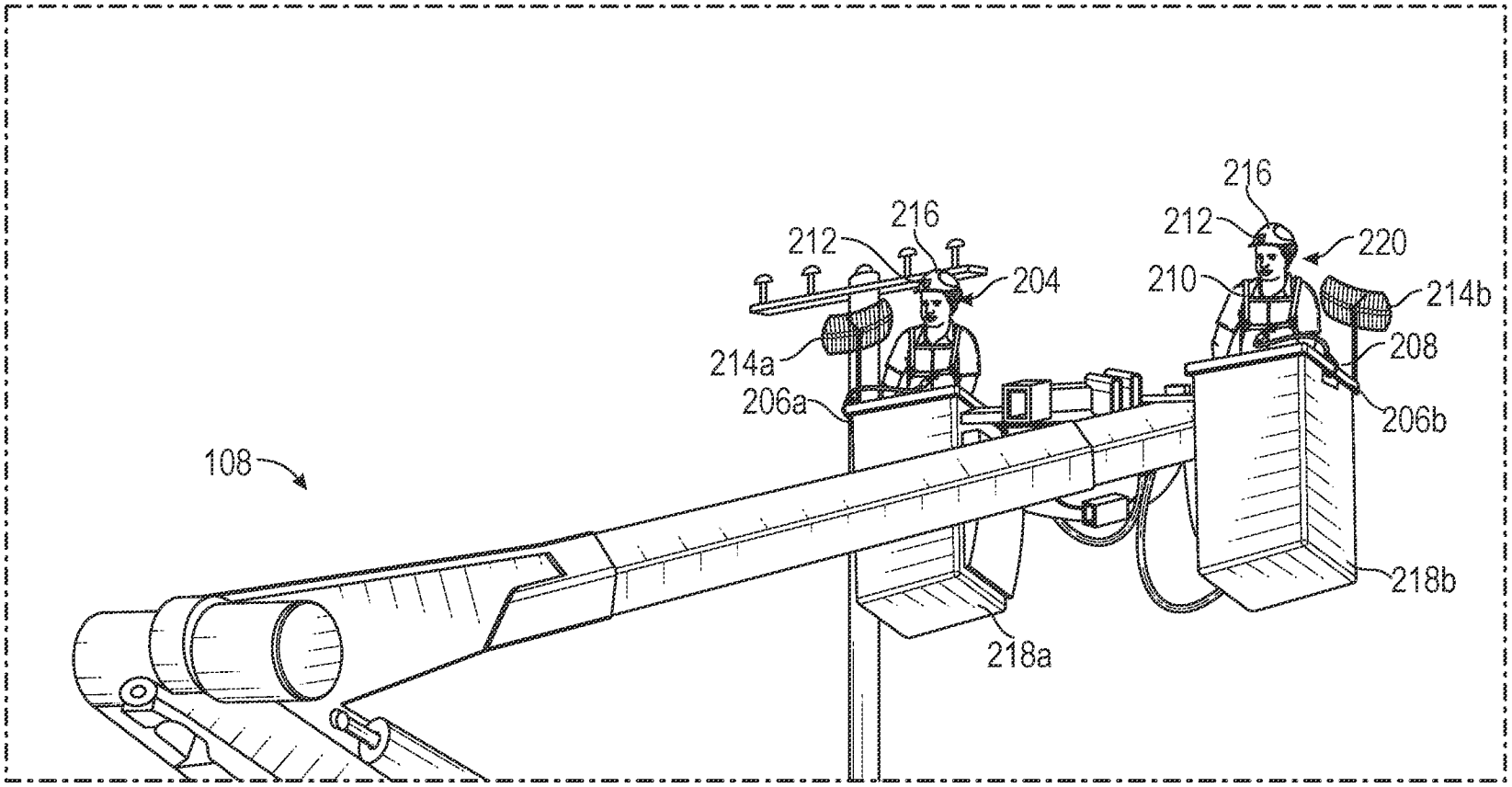

FIG. 2A illustrates a platform occupancy detection system 200 for some embodiments. Platform occupancy detection system 200 may comprise an aerial platform 202 configured to hold a worker 204 therein. Aerial platform 202 may be substantially similar to utility platform 110. Alternatively, or additionally, aerial platform 202 may be a multi-man aerial platform or any other aerial platform for holding workers 204 therein. A multi-man aerial platform 202, such as depicted in FIG. 2A may have a base area of about 60 inches by 40 inches (or 2,400 square inches). A bucket aerial platform, such as depicted in FIG. 2B may have a base area of about 24 inches square (or 576 square inches). Aerial platform 202 may be attached at a distal end of an aerial device 100 and raised to remote areas to allow workers 204 to perform work in such areas.

Aerial platform 202 may comprise a first side 206*a* substantially opposite a second side 206*b*, and a third side 206*c* substantially opposite a fourth side 206*d*. Aerial platform 202 may present a base area that is substantially rectangular. Thus, third side 206*c* and fourth side 206*d* may have a greater length than first side 206*a* and second side 206*b*. In some embodiments, aerial platform 202 presents a base area that is substantially square, elliptical, circular, D-shaped, triangular, trapezoidal, or any other geometric shape.

To prevent worker 204 from falling out of aerial platform 202, an interlock 208 may be utilized. The interlock 208 may comprise a lanyard configured to attach at a first end to worker 204 and at a second end to aerial platform 202. In some embodiments, interlock 208 is configured to attach to a safety harness 210 or other fall arresting system worn by worker 204. Interlock 208 may further comprise mechanisms for detecting when the interlock is connected and/or disconnected. As discussed further below, interlock 208 may be coupled to a control system 300 (see FIG. 3) to prevent certain operations of aerial device 100 based upon a detected connection of interlock 208 to worker 204.

As previously described, without knowing the number of workers 204 present in aerial platform 202, control system 300 may be unable to determine how many connected interlocks 208 should be detected before allowing operation of aerial device 100. As such, to detect the presence of worker 204 within aerial platform 202, positioning systems and methods may be employed. The positioning system may comprise a transmitter 212 associated with worker 204, along with a first receiver 214*a* and a second receiver 214*b*. In some embodiments, transmitter 212 is disposed on a hard hat 216 worn by worker 204. Alternatively, or additionally, transmitter 212 may be attached to clothing worn by worker 204 (e.g., safety harness 210, chest protector, work gloves, etc.). In some embodiments, a mobile device associated with worker 204 functions as transmitter 212 (e.g., a mobile phone equipped with BLUETOOTH). Transmitter 212 may be configured to wirelessly emit radio signals that are received by receivers 214*a*, 214*b*. The time at which transmitter 212 transmits the signal may be referred to as the time of transmission (ToT). The signal may be transmitted at a known waveform and/or speed. In some embodiments, the signal comprises a message payload. The message payload may comprise various data and/or metadata, such as an specific identifier for transmitter 212 (thereby identifying worker 204) and/or a timestamp for the signal.

In some embodiments, transmitter 212 comprise a radio frequency identification (RFID) tag that may be triggered whenever worker 204 enters aerial platform 202. For example, a RFID reader device may be placed near an ingress/egress area on aerial platform 202 such that a first triggering of the RFID reader is indicative of worker 204 entering aerial platform 202, and a second triggering of the RFID reader is indicative of worker 204 exiting aerial platform 202.

First receiver 214*a* may be disposed at a first side 206*a* of aerial platform 202, and second receiver 214*b* may be disposed at a second side 206*b* of aerial platform 202. In some embodiments, receivers 214*a*, 214*b* are attached to a safety rail of aerial platform. First side 206*a* may be substantially opposite second side 206*b*. In some embodiments, receivers 214*a*, 214*b* may be disposed substantially opposite one another on third side 206*c* and fourth side 206*d*. Alternatively, in some embodiments, receivers 214*a*, 214*b* may be disposed on adjacent side of aerial platform 202. In some embodiments, receivers 214*a*, 214*b* are disposed on aerial platform 202 at a furthest possible distance from one another. For example, when aerial platform 202 is a circular aerial platform 202, first side 206*a* and second side 206*b* may be diametrically opposed points on aerial platform 202.

In some embodiments, receivers 214*a*, 214*b* comprise internal clocks synchronized with one another, control system 300, transmitter 212, or a combination thereof. While only two receivers 214*a*, 214*b* are depicted, additional receivers 214*a*, 214*b* may be used in embodiments described herein. For example, a third receiver may be added, and the three receivers positioned to form a triangle on aerial platform 202. In some embodiments, receivers 214*a*, 214*b* comprise directional antennas (e.g., Yagi, loop aerial, etc.). In some embodiments, transmitter 212 and/or receivers 214*a*, 214*b* are configured as transceivers and may be configured to transmit and receive signals to/from control system 300 as discussed further below. In some embodiments, the positions of receivers 214*a*, 214*b* on aerial platform 202 are fixed and stored for determining if transmitter 212 resides within the area of aerial platform 202.

In some embodiments the platform area is a predefined area stored within control system 300. For example, first receiver 214*a* may be considered an origin point, and a geometric shape formed by receivers 214*a*, 214*b* and the known dimensions of aerial platform 202 may be used to determine the predefined area. As such, any transmitter 212 located within this predefined area may be considered to be a worker 204 that is on the aerial platform 202.

Based on the position of transmitter 212, receivers 214*a*, 214*b* may receive the transmitted signal at different times. The receiver 214*a*, 214*b*, to which transmitter 212 is closest to at the time of signaling may receive the signal first. The time at which a receiver 214*a*, 214*b* receives the signal may be referred to as the time of arrival (TOA). The time difference between the time of arrival and the time of transmission may be referred to as the time of flight (ToF). The difference between the time of arrival for first receiver 214*a* and the time of arrival for the second receiver 214*b* may be referred to as the time difference of arrival (TDOA). The TDOA may then be used to determine the position of transmitter 212. A TDOA value may be converted to a distance by multiplying the TDOA value with the propagation speed of the transmitted signal. In some embodiments, determining occupancy using multilateration techniques comprises additional receivers (i.e., three or more receivers) to determine the position of transmitter 212. Alternatively, or additionally, transmitter 212 may be triangulated by determining the angle from each of first receiver 214*a* and second receiver 214*b* to transmitter 212. In still other embodiments, the principles of trilateration may be used to locate transmitter 212 by determining the distance between each of receivers 214*a*, 214*b* and transmitter 212. Broadly, embodiments herein may utilize any radio direction finding technique to locate transmitter 212.

FIG. 2B illustrates a second embodiment of platform occupancy detection system 200 wherein multiple aerial platforms 202 form an aerial platform system. As illustrated, a first aerial platform 202 is first bucket 218*a* and a second aerial platform 202 is second bucket 218*b*. Buckets 218*a*, 218*b* may be disposed on a distal end of upper boom section 108 on a distal end of aerial device 100. A second worker 220 may be disposed in second bucket 218*b*, and second worker 220 may have an associated transmitter 212. Each bucket 218*a*, 218*b* may be provisioned with an interlock 208. The interlock 208 may attach to a rib or lip of bucket 218*a*, 218*b*. In some embodiments, when multiple aerial platforms 202 are present, first side 206*a* may be a side of the first aerial platform 202 (e.g., first bucket 218*a*), and second side 206*b* may be a side of the second aerial platform 202 (e.g., second bucket 218*b*). As previously described, side 206*a*, 206*b* may be disposed at a furthest extent from one another. Alternatively, in some embodiments, receivers 214*a*, 214*b* may not be disposed at the furthest extent from one another. For example, first receiver 214*a* may be disposed at first side 206*a* as depicted, while second receiver 214*b* may be disposed at an inner side of second bucket 218*b*. Similarly, both receivers 214*a*, 214*b* may be disposed at inner side of buckets 218*a*, 218*b*. Broadly, any positioning of receivers on aerial platform 202 or buckets 218*a*, 218*b* is considered for embodiments herein. Further, embodiments are considered wherein no receivers 214*a*, 214*b* are present and remote receivers (e.g., satellites) may be used for the platform occupancy detection system 200.

When an operator of the utility vehicle (e.g., workers 204, 220, or an operator at the base of aerial device 100) wishes to operate upper boom section 108 to raise buckets 218*a*, 218*b*, the positioning system may determine how many workers 204, 220 are present in the aerial platform system. In some embodiments, the utility vehicle operator actuates lower controls at the base of the utility vehicle 102 or workers 204, 220 may operate upper controls disposed in aerial platform 202 (e.g., a power-on switch) to begin operation of the aerial platform 202. In response to the actuation of the control, transmitters 212 may emit a signal. Thereafter, receivers 214*a*, 214*b* may receive the signal and the time difference thereof may be used to determine the number of workers 204, 220 present in buckets 218*a*, 218*b*. Once the number of workers 204, 220 is determined, the platform occupancy detection system 200 may determine if the number of connected interlocks 208 is equivalent to the number of detected workers 204, 220. If the number of connected interlocks 208 is not equal to the number of detected workers 204, 220, operation of the aerial device 100 may be prevented. Alternatively, or additionally, an audio and/or visual alarm may be activated.

Figure 3:
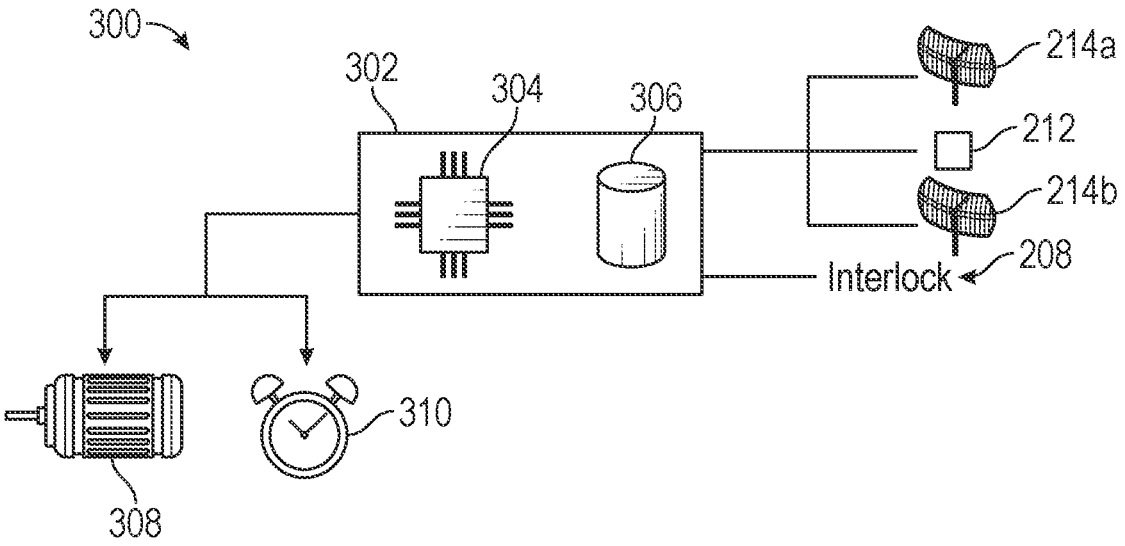
FIG. 3 depicts a control system for the platform occupancy detection system for some embodiments.

Turning now to FIG. 3, an exemplary control system 300 for some embodiments is illustrated. In some embodiments, control system 300 comprises a controller 302, which may be a microcontroller. Controller 302 may be a controller of the aerial device 100 and/or controller of the aerial platform 202. In some embodiments, controller 302 receives signals for controlling operations of aerial device 100. Responsive to receiving the signal, controller 302 may signal transmitter 212 to send a signal to receivers 214*a*, 214*b* such that a platform occupancy check may be performed. In some embodiments, controller 302 comprises at least one processing element 304 and at least one storage element 306. In some embodiments, the storage element 306 comprises computer-readable instructions that may be executed by the processing element 304 in order to control operation of the aerial platform 202 or to perform any other function described herein. For example, raising and/or lowering of upper boom section 108 may be controlled by the at least one processing element of controller 302.

In some embodiments, controller 302 receives a signal from receivers 214*a*, 214*b*. In some embodiments, the signal is indicative of the TOA of the signal from transmitter 212. Controller 302 may then compare the TOA from each of first receiver 214*a* and second receiver 214*b* (and any other receivers, if present) to determine the TDOA between receivers 214*a*, 214*b*. In some embodiments, controller 302 receives the emitted signal from transmitter 212. Controller 302 may extract the above-described data from the message payload of the signal. For example, controller 302 may extract the timestamp for locating transmitter 212 using multilateration. Additionally, controller 302 may store identifiers for transmitter 212 (e.g., in storage element 306 or in the cloud). The stored identifiers may be used to log events, such as a worker 204, 220 attempting to operate aerial device 100 without connecting to interlock 208. As such, a record may be gathered of workers 204, 220 who are not following the requisite safety procedures.

Controller 302 may also receive a detection signal from interlock 208 indicative of a connection of the interlock 208 to a worker 204, 220 in aerial platform 202. In some embodiments, controller 302 is connected to interlock 208 using fiber optics, thereby allowing communications from interlock 208 to utility vehicle 102 in such a case where aerial platform 202 is insulated from the base of aerial device 100.

Controller 302 may be communicatively coupled to motor 308 such that controller 302 may control operations thereof. As previously mentioned, preventive measures may be taken if a discrepancy exists between the number of workers 204, 220 and the number of interlock connections as detected by interlocks 208. Motor 308 may be any suitable type of motor to control utility vehicle 102 such as a hydraulic motor, an electric motor, or a pneumatic motor. In some embodiments, motor 308 is hydraulically powered, such as with a hydraulic pump, and operations thereof can be controlled by regulating hydraulic pressure and/or hydraulic fluid provided to the motor 308. A hydraulic power system for powering aerial device 100 may comprise motor 308, a hydraulic pump, electronics and control systems for controlling the pump and motor 308. In some embodiments, operations of motor 308 may be ceased. Control system 300 may output signals to control a plurality of actuators that enable and disable components of aerial device 100 by controlling solenoid valves controlling the flow of hydraulic fluid to allow motion of boom assembly 104, aerial platform 202, as well as anywhere else on aerial device 100. Alternatively, or additionally, in some embodiments, operations of aerial device 100 may be prevented by interrupting electronic signals and/or ignoring received signals. For example, an operator may input a control signal to raise aerial platform 202. This control signal may be received by control system 300 whereby control system 300 signals motor 308 and other components of aerial device 100 accordingly. However, if the number of workers 204, 220 differs from the number of connected interlocks 208, control system 300 may ignore the received signal and forgo signaling aerial device 100 to raise aerial platform 202. As another example, when a control in utility vehicle 102 and/or aerial platform 202 is actuated, the electronic signal sent therefrom may be interrupted to prevent operations of aerial device 100. Broadly, any method of preventing operation of aerial device 100 responsive to a determined discrepancy between the number of workers 204, 220 and the connected interlocks 208 is considered for embodiments herein.

In some embodiments, hydraulic operation of utility platform tools is maintained while upper controls at aerial platform 202 are disabled. Exemplary utility platform tools may be hydraulic and electric tools, jib tools, and any other tools that may be operated at aerial platform 202. In some embodiments, actuation of aerial platform 202, such as rotate and tilt, may be limited based on the state of the platform occupancy detection system 200. Utility platform tools may be powered by motor 308 or a separate motor and electrical power sources disposed at the boom tip and electrically isolated from ground components at the base. As such, in some embodiments, the operator may rotate and tilt the utility platform and use the utility platform tools while interlock 208 is not attached. Therefore, the upper controls may be disabled, preventing workers 204, 220 from operating turntable 106 and boom assembly 104; however, the worker 204, 220 may perform work duties using the utility platform tools. In some embodiments, rotate and tilt operation of aerial platform 202 may also be disabled.

Controller 302 may also be coupled to alarm 310. In some embodiments, alarm 310 is actuated in response to a discrepancy between the number of workers 204, 220 and the number of detected safety interconnects. In some embodiments, alarm 310 comprises a visual or audible alarm. For example, a display screen in utility vehicle 102 and/or on aerial platform 202 may display a warning when an operator therein attempts to raise upper boom section 108 when a worker 204, 220 is not connected. Additionally, or alternatively, an audible alarm may be sounded in utility vehicle 102 and/or on aerial platform 202.

In some embodiments, preventive measures are dependent upon a mode of operation of aerial device 100. In some embodiments, the mode of operation of aerial device 100 is one of a boom up or a boom down mode. A boom up operation is representative of a raising of aerial platform 202 (e.g., via raising/extending upper boom section 108), while a platform down operation is representative of a lowering of aerial platform 202. Other example modes of aerial device 100 included, but are not limited to, a change from lower controls to upper controls, a change from crane mode to aerial mode, a system startup action, or any other mode change of aerial device 100.

In some embodiments, fewer preventive measures may be taken in response to a discrepancy in the number of workers 204, 220 present and interlock connections if aerial device 100 is in a boom down mode. When in the boom down mode, the effects of fall damage may be lessened as aerial platform 202 continually descends. In the event of an injury to a worker 204, 220 when working in aerial platform 202, it may be advantageous to permit operation of aerial device 100 in order to quickly bring the injured worker to the ground. In some embodiments, an override control may be present in aerial platform 202 and/or utility vehicle 102 for overriding the platform occupancy check.

Further, embodiments are considered wherein additional preventive measures are taken when aerial platform 202 is being raised and/or held stationary. For example, as an increased safety measure, the platform occupancy check may be performed intermittently while aerial platform 202 is being raised or held stationary to ensure workers 204, 220 stay connected to interlock 208. The frequency of the platform occupancy check may be configured by an operator. Additionally, as previously mentioned, the platform occupancy check may be performed in response to actuation of a control for aerial device 100.

Figure 4:
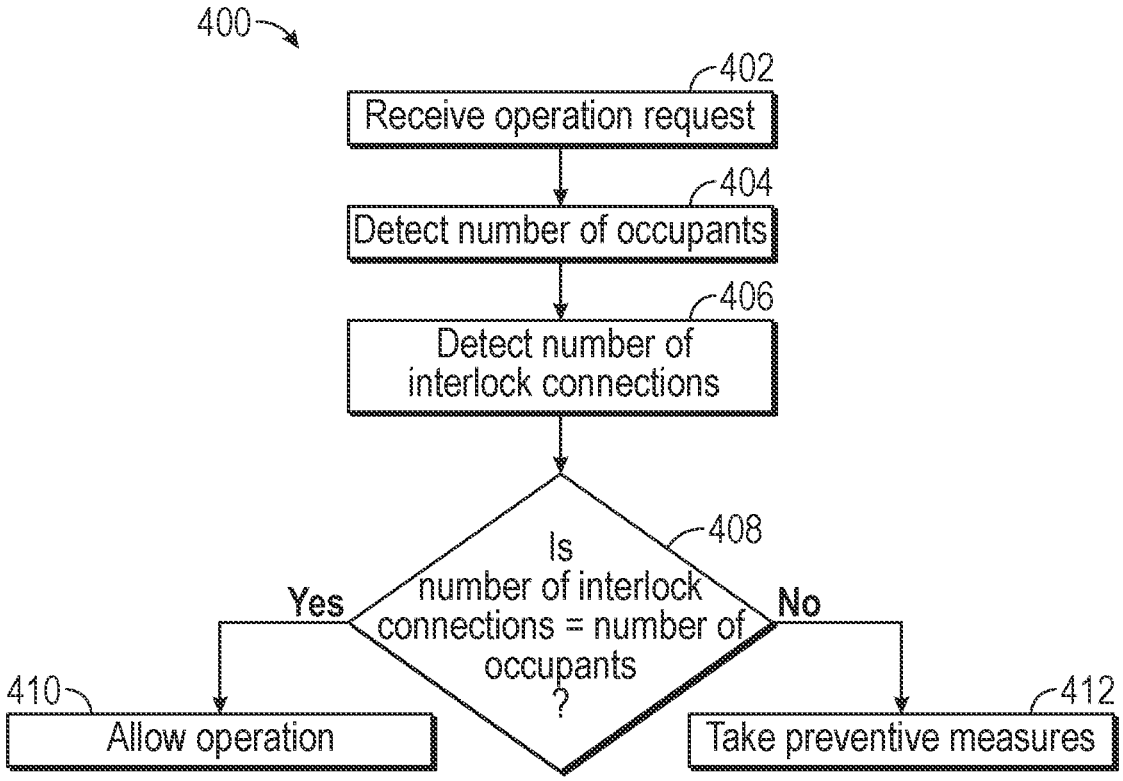
FIG. 4 depicts an exemplary method for platform occupancy detection for some embodiments.

Turning now to FIG. 4, an exemplary flow diagram 400 is depicted relating to some embodiments. In some embodiments, flow diagram 400 may describe the operations of controller 302 or of the platform occupancy detection system 200 as a whole. At step 402, an operations request may be received. The operations request may comprise an operator input to operate the utility vehicle 102 (e.g., a start-up input, perform a boom up or boom down function, etc.). The operations request may be received from lower controls at the base of aerial device 100, from the upper controls on aerial platform 202, or may be received remotely. Responsive to receiving the operations request, controller 302 may instruct transmitter 212 to send a signal to receivers 214*a*, 214*b*.

Next, at step 404, the number of workers 204, 220 present in aerial platform 202 may be detected. As described above, the occupancy detection may be performed using triangulation, trilateration, multilateration, or any combination thereof. Receivers 214*a*, 214*b* may receive the emitted signal from transmitter 212. Based on the TDOA, control system 300 may determine if transmitter 212 is located within the area of the aerial platform. Each transmitter 212 detected within the platform area may be indicative of a worker 204, 220 present within the platform area.

Next, at step 406, the number of safety connections may be detected. Each worker 204, 220 may have an associated safety connection, such as the aforementioned interlock 208, to which they are required to connect to in order to prevent falls from aerial platform 202. Control system 300 may be configured to detect when a connection is made to the interlock 208.

At step 408, it may be determined whether the number of workers 204, 220 present is equal to the number of interlock connections detected. If the number of workers 204, 220 is equal to the number of interlock connections detected, processing may proceed to step 410. If the number of workers 204, 220 is not equal to the number of interlock connections, processing may proceed to step 412. In some embodiments, the comparison may be a greater than comparison such that detecting a higher number of interlock connections than the number of workers 204, 220 may satisfy the conditions of step 408.

At step 410, whereby the number of workers 204, 220 present is equivalent to the number of interlock connections detected, operation of aerial device 100 may be permitted. The operator may then raise and lower aerial platform 202 and allow workers 204, 220 to perform their work. In some embodiments, transmitter 212 is triggered periodically and/or upon operator input during operation to ensure that each worker 204, 220 is still connected to interlock 208 within aerial platform 202.

At step 412, whereby the number of workers 204, 220 present is not equivalent to the number of interlock connections detected, preventive measures may be taken. In some embodiments, preventive measures comprise preventing operation of utility vehicle 102 and/or aerial platform 202. Preventing operations may be done by controlling motor 308, disabling upper/lower controls, or ignoring signals as previously described. In some embodiments, the preventive measures comprise actuating alarm 310 to alert the utility vehicle operator and/or workers 204, 220 in aerial platform 202.

While embodiments herein have been described with respect to detecting platform occupancy on aerial platforms 202, embodiments are also contemplated wherein the position of a worker 204 is triangulated to improve worksite safety and/or to detect the presence of a worker 204 within an area other than aerial platform 202.

As one example, cabins of utility vehicles 102 (e.g., crane cabins, truck cabins, etc.) are often equipped with their own interlock systems. These interlock systems may be substantially similar to the above-described interlock 208 and may be used to ensure an operator is within the cabin before operation is permitted. Alternatively, cabin interlock systems may utilize pressure sensors in an operator seat to determine if an operator is within the cabin. If the operator stands up, the interlock system may signal that no operator is present even when the operator remains in the cabin. As such, it is contemplated that receivers 214*a*, 214*b* may be disposed in the cabin and a transmitter 212 attached to the operator to determine occupancy within the cabin. Advantageously, the operator may be able to stand up while operating the aerial device without operations thereof being prevented by the interlock system.

Similarly, as another example, embodiments are considered wherein the position of workers 204 may be determined for proximity warning. For example, if first worker 204 is on the ground at a job site, and second worker 220 is operating aerial device 100, second worker 220 may be unable to see first worker 204. For example, first worker 204 may be in a dangerous position relative to aerial device 100, such as below an elevator when the elevator is being lowered. However, by equipping first worker 204 with transmitter 212 and disposing receivers 214*a*, 214*b* within the worksite, the first worker 204 can be seen. If the position of first worker 204 is triangulated to be in a dangerous position, alarm 310 may be sounded to warn workers 204, 220. Alternatively, or additionally, operations of nearby aerial devices 100 may be prevented. In some such embodiments, transmitter 212 and receivers 214*a*, 214*b* may be communicatively coupled to a central computing system which may be connected to the various vehicles and aerial devices in the worksite for controlling operations thereof.

Although the invention has been described with reference to the embodiments illustrated in the attached drawing figures, it is noted that equivalents may be employed, and substitutions made herein without departing from the scope of the invention as recited in the claims.

Having thus described various embodiments of the invention, what is claimed as new and desired to be protected by Letters Patent includes the following:

1. A system for platform occupancy detection on an aerial platform, the system comprising:

the aerial platform disposed at a distal end of an aerial device, the aerial platform comprising a first side and a second side;

a transmitter for transmitting a signal configured to be associated with a worker;

a first receiver disposed at the first side of the aerial platform and configured to receive the signal from the transmitter;

a second receiver disposed at the second side of the aerial platform and configured to receive the signal from the transmitter; and at least one processor, and one or more non-transitory computer-readable medium storing computer-executable instructions that, when executed by the at least one processor, cause the system to carry out actions comprising:

receiving a first time from the first receiver, the first time indicative of a time at which the signal was received at the first receiver;

receiving a second time from the second receiver, the second time indicative of a time at which the signal was received at the second receiver; and determining a position of the transmitter based on a time difference between the first time and the second time.

2. The system of claim 1, wherein the non-transitory computer-readable medium stores additional computer-executable instructions that, when executed by the at least one processor, cause the system to carry out actions comprising:

determining if an interlock device is connected to the aerial platform; and responsive to determining that the interlock device is not connected to the aerial platform, preventing operation of the aerial device.

3. The system of claim 2, wherein preventing operation of the aerial device comprises disabling a hydraulic power system powering the aerial device.

4. The system of claim 2, wherein preventing operation of the aerial device comprises an interruption of electronic signals controlling operation of the aerial platform.

5. The system of claim 2, wherein the system further comprises:

an alarm, wherein the alarm is activated when it is determined that the interlock device is not connected to the aerial platform.

6. The system of claim 1, wherein the transmitter is disposed on a hard hat configured to be associated with the worker.

7. The system of claim 1, wherein determining the position of the transmitter comprises using one of triangulation, trilateration, or multilateration.

8. The system of claim 1, wherein the first receiver and the second receiver are attached to a safety rail of the aerial platform.

9. The system of claim 1, wherein the first side and the second side are opposite from one another.

10. A computer-implemented method for platform occupancy detection on an aerial platform, the computer-implemented method performed using at least one processor and one or more non-transitory computer-readable medium storing computer-executable instructions that, when executed by the at least one processor, cause the at least one processor to perform operations, comprising:

receiving an actuation of a control for operation of an aerial platform, said aerial platform disposed at a distal end of an aerial device;

responsive to receiving the actuation of the control, transmitting a signal from a transmitter associated with a worker;

receiving the signal at a first receiver at a first time, the first receiver disposed at a first side of the aerial platform;

receiving the signal at a second receiver at a second time, the second receiver disposed at a second side of the aerial platform;

determining if the transmitter is within the aerial platform based on a time difference between the signal received at the first receiver at the first time and the signal received at the second receiver at the second time; and responsive to determining that the transmitter is not within the aerial platform, performing a preventative operation associated with the operation of the aerial platform.

11. The computer-implemented method of claim 10, the operations further comprising determining if an interlock device is connected to the aerial platform.

12. The computer-implemented method of claim 11, the operations further comprising:

responsive to determining that the interlock device is not connected to the aerial platform, preventing operation of the aerial platform.

13. The computer-implemented method of claim 11, the operations further comprising:

further responsive to determining that the interlock device is not connected to the aerial platform, logging an identifier associated with the transmitter.

14. The computer-implemented method of claim 10, the operations further comprising:

further responsive to determining that the transmitter is not within the aerial platform, activating an alarm.

15. The computer-implemented method of claim 10, wherein the transmitter is disposed within or upon a safety harness or a hard hat configured to be worn by a worker.

16. A system for occupancy detection on an aerial device comprising:

an aerial platform system comprising a first side and a second side;

at least one transmitter configured to be associated with a worker on the aerial platform system;

at least one interlock configured to secure the worker to the aerial platform system;

a first receiver disposed at the first side of the aerial platform system and configured to receive a signal from the at least one transmitter;

a second receiver disposed at the second side of the aerial platform system and configured to receive the signal from the at least one transmitter; and at least one processor, and one or more non-transitory computer-readable medium storing computer-executable instructions that, when executed by the at least one processor, cause the system to carry out actions comprising:

receiving a first time indicative of a length of time for the signal to reach the first receiver;

receiving a second time indicative of a length of time for the signal to reach the second receiver;

determining a position of the at least one transmitter based on the first time and the second time;

determining if the at least one interlock is connected to the aerial platform system; and in response to determining the position of the at least one transmitter is within the aerial platform system and determining that the at least one interlock is connected to the aerial platform system, permitting operation of the aerial device.

17. The system of claim 16, wherein the aerial platform system comprises a first aerial platform and a second aerial platform, wherein the first side of the aerial platform system is a first side of the first aerial platform, wherein the second side of the aerial platform system is a second side of the second aerial platform, and wherein the second side of the second aerial platform is a furthest end from the first side of the first aerial platform.

18. The system of claim 17, wherein the at least one transmitter comprises a first transmitter associated with a first worker and a second transmitter associated with a second worker, and wherein the at least one interlock comprises a first interlock and a second interlock.

19. The system of claim 16, wherein the system further comprises a mobile device configured to be associated with the worker, the mobile device comprising the at least one transmitter.

20. The system of claim 16, wherein the aerial device comprises a boom, and wherein the non-transitory computer-readable medium stores additional computer-executable instructions that, when executed by the at least one processor, cause the system to carry out actions comprising:

determining a mode of operation of the boom, the mode of operation comprising one of a boom up mode or a boom down mode.

21. The system of claim 20, wherein the non-transitory computer-readable medium stores additional computer-executable instructions that, when executed by the at least one processor, cause the system to carry out actions comprising:

responsive to determining the mode of operation is the boom up mode and the at least one interlock is not connected to the aerial platform system, preventing operation of the aerial device.

22. The system of claim 20, wherein the computer-readable medium stores additional computer-executable instructions that, when executed by the at least one processor, cause the system to carry out actions comprising:

responsive to determining the mode of operation is the boom down mode and the at least one interlock is not connected to the aerial platform system, permitting operation of the aerial device.

23. The system of claim 16, wherein the first receiver and the second receiver are attached to a safety rail of the aerial platform system.

24. The system of claim 16, wherein the first side and the second side are opposite from one another.

* * * * *